US008857977B2

(12) United States Patent
Grant et al.

(10) Patent No.: US 8,857,977 B2
(45) Date of Patent: Oct. 14, 2014

(54) METHOD, APPARATUS AND SYSTEM FOR MEASURING THE TRANSPARENCY OF FILM

(75) Inventors: Alexander Grant, Bath (GB); Nigel Anthony Caiger, Somereset (GB)

(73) Assignee: Sun Chemical B.V., Weesp (NL)

( * ) Notice: Subject to any disclaimer, the term of this patent is extended or adjusted under 35 U.S.C. 154(b) by 1975 days.

(21) Appl. No.: 11/911,923

(22) PCT Filed: Apr. 7, 2006

(86) PCT No.: PCT/GB2006/001282
§ 371 (c)(1),
(2), (4) Date: Jan. 19, 2011

(87) PCT Pub. No.: WO2006/111707
PCT Pub. Date: Oct. 26, 2006

(65) Prior Publication Data

US 2011/0109712 A1 May 12, 2011

(30) Foreign Application Priority Data

Apr. 19, 2005 (GB) ..... 0507904.1

(51) Int. Cl.

| | |
|---|---|
| ***B41J 2/01*** | (2006.01) |
| ***B41J 11/00*** | (2006.01) |
| ***B41M 5/52*** | (2006.01) |
| *B41M 5/00* | (2006.01) |

(52) U.S. Cl.
CPC ..... *B41M 5/52* (2013.01); *B41J 11/0015* (2013.01); *B41M 5/0058* (2013.01); *B41M 5/007* (2013.01); *B41M 5/0047* (2013.01); *B41M 5/0064* (2013.01); *B41M 5/0011* (2013.01)
USPC ..... 347/105

(58) Field of Classification Search
CPC ..... B41J 11/0015; B41M 5/0011
USPC ..... 347/16, 20, 21, 96, 100, 102
See application file for complete search history.

(56) References Cited

U.S. PATENT DOCUMENTS

| | | | | |
|---|---|---|---|---|
| 6,935,732 | B2 * | 8/2005 | Takada et al. | 347/96 |
| 2004/0201658 | A1 | 10/2004 | Jackson et al. | |
| 2005/0275704 | A1 * | 12/2005 | Yamaguchi et al. | 347/102 |
| 2006/0007288 | A1 * | 1/2006 | Takada et al. | 347/100 |
| 2006/0008713 | A1 * | 1/2006 | Toyoda | 430/7 |
| 2007/0132811 | A1 * | 6/2007 | Okano et al. | 347/54 |
| 2009/0085960 | A1 * | 4/2009 | Yahiro et al. | 347/21 |
| 2012/0212538 | A1 * | 8/2012 | Annable et al. | 347/20 |
| 2012/0327157 | A1 * | 12/2012 | Iijima et al. | 347/20 |

FOREIGN PATENT DOCUMENTS

| | | | |
|---|---|---|---|
| EP | 0232040 | A2 | 12/1987 |
| EP | 0781818 | A2 | 2/1997 |
| JP | 2003 231278 | A | 8/2003 |
| JP | 2004 009483 | A | 1/2004 |
| JP | 2005059546 | A | 3/2005 |
| WO | 99/33906 | A1 | 7/1999 |

OTHER PUBLICATIONS

BR0507904 Search Report under Section 17, Sep. 21, 2005.

* cited by examiner

*Primary Examiner* — Alessandro Amaro
*Assistant Examiner* — Alexander C Witkowski
(74) *Attorney, Agent, or Firm* — Charles C. Achkar; Ostrolenk Faber LLP

(57) ABSTRACT

A process of ink jet printing on a variety of substrates and an apparatus for performing that process. In which process: a primer is applied to a substrate material; ink is ink jet printed onto the primed substrate; a characteristic relating to print quality is evaluated; the composition of the primer is adjusted in dependence on the evaluated characteristic relating to print quality; and the adjusted primer composition is applied to the substrate material and ink is ink jet printed onto the primed substrate material to give a printed product.

18 Claims, No Drawings

METHOD, APPARATUS AND SYSTEM FOR MEASURING THE TRANSPARENCY OF FILM

CROSS REFERENCE TO RELATED APPLICATIONS

This application is the U.S. national stage filing of the corresponding international application number PCT/GB2006/001282 filed on Apr. 7, 2006, which claims priority to and benefit of Great Britain Application No. 0507904.1 filed Apr. 19, 2005, each of which is hereby incorporated herein by reference.

The present invention relates to a method of ink jet printing and to an apparatus for ink jet printing.

The control of ink wetting on the substrate, that is, the degree to which the droplets of ink spread upon the substrate surface and coalesce with neighbouring droplets, is fundamental to achieving satisfactory print quality. For example, insufficient wetting of the substrate by the ink may lead to gaps between adjacent rows of ink droplets which appear in the printed article as lines or bands running in the direction of printing. Conversely, too high a degree of wetting on the substrate may cause the ink to spread too far on the substrate surface, causing a loss of edge definition, which is especially undesirable in print jobs requiring high resolution such as areas of text.

The print behaviour of the ink on the substrate, and therefore the print quality, is also heavily dependent on the porosity of the substrate. On porous substrates, such as cardboard and paper, the ink may be drawn down into the pores of the substrate, thereby leaving less ink on the surface and leading to an image of low colour strength. On non-porous substrates, such as plastic and metallic films, which also tend to have low surface energies, the inks may exhibit poor wetting of the substrate and the dried ink layer may suffer from poor adhesion to the substrate. Prior surface treatments of the substrate, for example, corona or atomic plasma pre-treatment, have to some extent provided improved wetting and adhesion on particular substrates.

It has been proposed to overcome problems such as low adhesion of the ink to a substrate by applying a primer to the substrate prior to printing on it. However, different substrates require different primers and the range of commercially-available primers is limited. Those approaches therefore have not overcome the problem that the ink wetting behaviour of an ink varies from substrate to substrate.

For the above-mentioned reasons, the print quality obtained with a particular family of ink jet inks will vary greatly from substrate to substrate giving rise to a lack of consistency. That problem is exacerbated by the trend towards smaller print runs and the introduction of single-pass printers, which provide less scope for filling in the gaps between adjacent lines of ink droplets than scanning printers, and therefore are particularly prone to the printing defects mentioned above.

One possible approach to overcoming those problems would be to use a different family of inks for each print job, each family being tailored to the requirements of a particular substrate. However, that approach would require the printer to stock many families of jet ink and would also require a lengthy and costly changeover of inks whenever it was desired to change the substrate being printed on by a particular printer.

An alternative approach would be to print only onto substrates which have been coated with coatings which render those substrates well suited to ink jet printing. However, such coated substrates are expensive and may not be widely available or economic to transport from the manufacturer to where the printing is carried out. For example, suitably coated corrugated cardboards are few in number, are expensive and are costly to transport relative to their value.

There therefore remains a desire for an improved method and apparatus for ink jet printing which would allow the print operator to print on a wide variety of substrates, including inexpensive non-coated substrates, while keeping ink changes to a minimum and consistently obtaining good image quality.

The invention provides a process of ink jet printing in which:

i) a primer is applied to a substrate material;

ii) ink is ink jet printed onto the primed substrate;

iii) a characteristic relating to print quality is evaluated;

iv) the composition of the primer is adjusted in dependence on the evaluated characteristic relating to print quality; and v) the adjusted primer composition is applied to the substrate material and ink is ink jet printed onto the primed substrate material to give a printed product.

The invention also provides an ink jet printing apparatus comprising:

i) a reservoir of primer;

ii) means for adjusting the composition of the primer;

iii) means for applying the primer to a substrate; and iv) means for ink jet printing onto the primed substrate.

The process and apparatus of the invention allow the primer composition to be optimised for the substrate and for the nature of the print job in hand, thereby reducing or avoiding the need to change inks. For example, even on the same substrate it may be advantageous to use a first primer composition for a print job having a high text content and a second primer composition, different from the first, for a print job having large blocks of colour. Moreover, because the process and apparatus of the invention envisages adjusting the composition of the primer at the printing facility, the need for the printer to stock a wide range of primers is reduced and the printing process is made more efficient and flexible. For example, a print operator may commence a print run which requires printing on a porous substrate, for example, cardboard for wine boxes, with a particular primer composition, run a sample print using that primer, measure a print characteristic such as the linewidth, compare the measured value to a desired target value, adjust the composition of the primer composition in the reservoir, for example, by adding silica or a surfactant, in order to bring the print characteristic closer to the target value, and then begin printing. If necessary, the sample printing, linewidth evaluation and primer composition adjustment steps can be repeated several times in order to optimise the primer composition. Also, the evaluation of the linewidth can be continued during the print run, with any variations due to, for example, batch-to-batch variations in the substrate, being countered by making further adjustments to the primer composition.

The steps i) to iv) may be carried out off-line, that is prior to setting up the print run of step v) and, optionally, on a different printing apparatus. For example, a sample of the primer having an initial composition could be applied to a sample of substrate material, a test print carried out on that primed substrate and the characteristic relating to print quality evaluated off-line in a testing facility. The results of that evaluation be used to adjust the composition of a larger quantity of primer, that adjusted primer being used in the print run of step v). However, in order to ensure consistency, the application of primer to substrate in step i) is advantageously carried out using the same apparatus as is used to apply the primer in step v). Likewise, the printer used to print in step ii) is advantageously the same as the printer used in step v). Moreover, in the interests of efficiency, preferably at least steps i), ii), iv) and v) are carried out on-line during a printing run. For example, a printing line may be set up with a primer having an initial composition, a very small print run carried out, a characteristic relating to print quality such as linewidth evaluated off-line in a separate facility, and the results of that evaluation used to adjust the composition of the primer prior to commencing the main print run. Moreover, during the print run, the evaluation of the chosen characteristic may be repeated at intervals on samples of printed product produced in the main print run and further adjustments be made, if desired, to the composition of the primer.

In an especially favoured embodiment, the printing apparatus includes means for evaluating the chosen characteristic or the chosen characteristic is one which may be evaluated directly by the operator, and step iii) is also carried out on-line. In that embodiment, the delay and inconvenience of taking samples to a separate location for evaluation is avoided.

The term "on-line" as used herein will be understood to mean that the activity referred to is carried out on the print line and is part of the print run, as opposed to being carried our at a separate location such as a laboratory or at a time unrelated to the timing of the print run.

In a favoured embodiment, the primer is applied to the substrate less than 5 minutes before the substrate is carried into the print head of the printer. Advantageously, the substrate is cleaned of dust, for example by a jet of air, prior to application of the primer.

Where step iii) is carried out on-line it will usually be possible to carry out steps i) to iii) quite rapidly. Preferably, steps i), ii) and iii) are carried out in a period of less than 5 minutes, more preferably less than 1 minute and especially preferably less than 30 seconds.

The primer may be applied to the substrate by any suitable means, for example, by a brush, a roller, a knife or by spraying or any printing technique, including ink jet printing. The method of application will desirably be chosen to suit the physical characteristics of the primer, for example, the viscosity of the primer.

The primer may be applied to form a layer of any suitable thickness. In the case of primers comprising only a surfactant in a volatile solvent, the layer of surfactant left on the substrate after drying of the primer will typically be very thin. For primers having a significant solids content, say of more than 10%, especially primers comprising a resin and/or wax, the primer layer may have a thickness after drying, for example, in the range of from 1 μm to 15 μm, preferably from 1 μm to 10 μm, more preferably from 1 to 5 μm.

In some cases, it may be desired for the primer to be applied to only certain areas of the substrate, rather than across the whole of a surface of the substrate. For example, the primer may be applied only to those parts of the substrate which are to be printed on or even to only parts of the printed area, for example, parts which are to receive text. Optionally, the primer is applied in an image which corresponds to the image to be printed on the substrate. While such processes reduce the amount of primer required, it will in many cases be preferred to apply the primer broadly over the area to be printed.

The substrate may be any surface on which it is desired to print, for example, paper, cardboard, glass, metal or polymeric materials such as polyvinyl chloride or acrylate polymer sheets, polymeric films e.g. polyethylene, polypropylene, polyester or laminate structures. In one embodiment the substrate is a porous substrate, such as uncoated paper and cardboard, for example, corrugated cardboard of the type commonly used for manufacture of boxes, such as boxes for wine.

In a further embodiment, the process of the invention is a non-porous substrate, such as a polymeric film, glass or metal.

The invention is particularly suitable for use with single-pass ink jet printing devices. As the name implies, single-pass printing devices print an image in a single pass of the substrate past the print head, with each jet in the print head producing a single line of droplets in the print image. Whilst such printing devices are fast and economical to use, they are particularly susceptible to printing defects related to ink wetting behaviour.

The process and apparatus of the invention may be used with any type of ink jet ink. Known categories of ink jet ink include solvent-based, water-based, hot melt, and radiation-curable. Radiation-curable inks include those cured by UV light and those cured by electron beam radiation.

Advantageously, the image printed onto the substrate material in step ii) is the same as the image printed in step v), in order that the adjustment made to the primer composition is based on the printing of that particular image. However, in certain cases it may be desired to print an image in step ii) which differs from the image printed in step v), for example, it may be desired to print in step ii) an image which is adapted to show up certain defects of particular concern. Of course, when steps i) to v) are carried out on-line at intervals during a print-run it will usually be most convenient to print only the image which it is desired to produce in the printed product, in which case steps i) and ii) correspond to step v) and step iii) is carried out on samples of the final printed product.

A wide range of primer compositions are suitable for use in the process of the invention. The primer may include a volatile component, such as water or a volatile organic solvent, which dries away either before or after the ink jet printing to leave a dry layer of primer. Alternatively, the primer may be 100% solid formulation, i.e. comprising no component that is lost through drying. In that case, the primer will typically be radiation-curable and contain at least one component that can be cured by a radiation-induced reaction.

The primer composition must be such that it can be applied as a liquid which converts on the substrate to a layer of fixed primer material. The conversion mechanism may involve drying, radiation-curing, cooling or any other suitable process.

The primer composition, either initially or following adjustment, will in general comprise at least one component which modifies the wetting behaviour of the ink on the substrate, for example, a particulate filler or a surfactant. Where the substrate material is porous, the primer will advantageously comprise at least one component which at least partially fills and/or blocks the pores, such as a resin or a wax, and thereby inhibits the ink from being drawn down into the pores of the substrate material. Of course, those pore-filling components will in most cases also influence the wetting behaviour of the ink.

Preferably, the nature of the primer and the amount of primer applied per unit area are such that the wetting behaviour of the ink is determined principally by the ink-primer interactions rather than by ink-substrate interactions. In that way, variation in print quality from substrate-to-substrate is reduced.

The primer composition may be quite simple. For example, it has been found that a solution of a surfactant in an appropriate solvent can give good results when used as a primer on non-porous substrate materials in the process of the invention, and that the wetting behaviour of the ink and therefore the print quality can be influenced by adjusting either the concentration or the surfactant or by adding another surfactant or another component which influences wetting behaviour, such as a particulate filler.

The primer may comprise water, for example, up to 25%, optionally up to 50% and in some cases up to 80% water. The primer may comprise a volatile organic solvent, for example, up to 25%, optionally up to 50% and in some cases up to 80% of a volatile organic solvent. ("Volatile" will be understood to mean that the solvent is capable of evaporating away from a thin film e.g. 15 μm thick film of the primer composition in a period of an hour or less at room temperature to leave a dry primer layer.) For certain applications, however, it will be preferable for the primer to comprise less than 10%, preferably less than 2% or to be free of volatile organic solvents, for reasons of environmental acceptability.

The primer may comprise a resin, for example, a polymer or oligomer. The resin should preferably dry to a non-tacky film with the required flexibility for the end use. The resin may be present in solution. Alternatively, the resin may be present in the form of an emulsion, for example, an emulsion of a polymer or oligomer in water. Many such water dispersible polymers and oligomers will be known to the skilled person for use in coatings. The primer may comprise at least 10%, more preferably at least 40%, and optionally at least 60% of one or more polymers. Optionally, the primer comprises not more than 75% weight of polymeric components.

The primer may contain a wax. A primer including a wax when applied hot to the substrate has been found to give excellent results. It is believed that the wax is in a liquid state at the temperature of application of the primer but solidifies following cooling of the primer on contact with the substrate, thereby contributing to a rapid increase in viscosity. Preferably, the primer comprises in the range of from 2 to 10%, more preferably from 5 to 8% by weight of a wax based on the weight of the primer. Preferably, the wax is a microcrystalline wax, an alcohol wax, as ester wax, an ethoxylated wax or an amide wax.

As mentioned above, the primer may be radiation-curable.

The term "radiation-curable" as used herein means that curing is induced by one or more types of radiation, such as UV-light or electron beam (EB) radiation. In one embodiment, the primer is UV-curable and the process of the invention involves curing the primer by exposure to UV-light. UV-curable primers will, in general, comprise a photoinitiator, which may be a cationic photoinitiator or a free radical photoinitiator. In another embodiment, the primer is EB-curable and the process of the invention involves curing the primer by exposure to an electron beam. EB-curable primers usually do not require a photoinitiator, although one or more may be present.

Radiation-curable primers will contain at least one component that can be cured by a radiation-induced reaction. The radiation-curable components may be oligomeric or polymeric materials of relatively high molecular weight and/or are monomers having a relatively low number average molecular weight of less than 1000. The monomers may be monofunctional or multifunctional (that is, having more than one polymerisable group). Advantageously, the primer includes both monofunctional and multifunctional monomers. The skilled person will be aware that certain materials, particularly certain photoinitiators which are used in the inks, cause yellowing. Preferably the primer composition does not comprise any such yellowing component.

The radiation-curable component or components may be present in an amount of from 5% to 95% by weight, preferably from 10% to 90% by weight and more preferably from 30% to 70% by weight, based on the total weight of the primer.

Two suitable types of curing reaction which are well known in the ink jet and other fields are free-radical curing and cationic curing. Suitable free-radically curable components include ethylenically unsaturated monomers and oligomers such as acrylate and methacrylate monomers and oligomers, and vinyl components such as N-vinyl pyrolidone, N-vinyl caprolactam, vinyl ethers and styrenes.

Suitable cationically curable components include oxygen-containing ring opening monomers and oligomers such as those comprising an oxetane ring or an oxirane ring. Many suitable materials will be known to the skilled person.

In general, the primer and substrate should be such that the primer wets the substrate sufficiently well to form a film on the substrate when applied by the chosen method of application, and, where the substrate is porous, the primer should not have a viscosity so low that it is entirely drawn into the pores of porous substrates in the interval between application of the primer to the substrate and curing of the primer, although it may be advantageous for reasons of adhesion if the primer is drawn into the pores of the substrate to a limited extent.

The primer will in most cases be applied to the substrate at ambient temperature. In some cases, for example, where the primer has a relatively high viscosity or contains a wax, it may be desirable to apply the primer to the substrate at an elevated temperature, for example, a temperature higher than 40° C., optionally higher than 60° C.

In most cases, the primer will be colourless and transparent. However, in some cases it may be desirable to mask the colour of the substrate or provide a background colour for printing on by including in the primer a colourant such as a pigment or a dye.

Optionally, the primer is dried or partially dried or cured before ink is ink jet printed onto it. Where the primer is not radiation-curable and includes water or solvent, it may be desirable to dry the primer to give a layer of dry primer before printing. Such a drying step will be desirable particularly on non-absorbent substrates such as glass, metal and polymer sheets and films. On absorbent substrates, such as paper and cardboard, any water or volatile solvent in the primer may be at least partially absorbed by the substrate before the printing takes place, and it may therefore be unnecessary to include a drying step. Any water or solvent absorbed by the substrate will evaporate away over time from the printed product.

The primer may be dried in any suitable way, for example by passage through an oven or by a forced blast of hot air. In processes which include a drying step, the drying is preferably done on-line with the substrate being primed, dried, and then passed directly to the printer in a continuous operation. Accordingly, the printing apparatus, that is, the printing line, will preferably comprise drying means, such as an oven, located downstream of the means for applying the primer to the substrate and upstream of the print head.

Similarly, radiation-curable primers may be cured prior to printing, in which case the print line will include curing means, such as an array of UV lamps, downstream of the means for applying the primer and upstream of the print head. Alternatively, the printing may be done onto the uncured primer, with the primer being cured after the printing step. That is particularly convenient in processes in which the ink is also radiation-curable, and the ink and the primer can be cured together by the same curing means. In one embodiment, therefore, the print line includes a curing means downstream of the print head.

The ink is printed onto the primer, which as mentioned above may be wet or dry. The ink may be any ink suitable for use in ink jet printers, but is preferably radiation-curable, especially UV-curable. As also mentioned above, the image printed in step ii) may be a test image but is more preferably the image which it is desired to print onto the product in step v).

Any characteristic (or combination of more than one characteristic) which relates to the print quality of the printed image may be evaluated. The characteristic may be one which is susceptible to physical measurement, such as linewidth or the contact angle of the ink on the primed substrate. Alternatively, the characteristic may be one which can be evaluated by eye, such as the presence of defects such as streaking, white lines or mottle. The characteristic need not be one which is present in the printed image itself. For example, the contact angle of droplets of ink on the primed substrate may be measured at a particular time following the printing of those droplets onto the primed substrate, but the contact angle will, of course, continue to change until either an equilibrium contact angle is reached or the ink is fixed by drying or curing. The important point is that the characteristic evaluated provides information as to the print quality obtained in the printed product. Suitable characteristics for instrumental evaluation include linewidth, spot size, edge straightness, mottle, print density, gloss and colour intensity.

Optionally, the evaluation of the characteristic may involve comparing a measured value with a predetermined desired value.

The composition of the primer may be adapted in any suitable way to improve the print quality, based on the results of the evaluation. For instance, if an evaluation of the linewidth has revealed that the linewidth is too narrow, the composition of the primer is adjusted so as to increase the linewidth. The present inventors have found that particularly effective control of the print quality can be achieved by adjusting one or more of:

a) the concentration of surfactant in the primer;

b) the concentration of particulate filler in the primer; and c) the concentration of resin in the primer.

Effective control over the linewidth and contact angle of the ink on the printed substrate is provided by adjusting the concentration of surfactant and/or the concentration of particulate filler in the primer. The inventors have found that many surfactants, especially fluorinated surfactants, tend to reduce the linewidth obtained as compared to the linewidth obtained using the same ink under the same conditions and using a primer of corresponding composition but not including the surfactant. The surfactants may be anionic, cationic, nonionic or amphoteric, or a blend of more than one of those types of surfactants. Preferably, the surfactants are non-polymeric surfactants. The extent and direction of the change in linewidth varies according to the nature and concentration of the particular surfactant or surfactants chosen, the substrate, the ink and the other components or the primer. For example, the inclusion of 1% of a silicone surfactant in a water-based UV-curable primer has been found to increase the linewidth of an ink printed onto polyester sheet or white aluminium foil, as compared to the same primer without the silicone surfactant. However, fluorinated surfactants have been found to decrease linewidth. The skilled person will be able to establish, by means of routine testing, for any substrate and ink what the effect of varying the concentration of a surfactant or range of surfactant will be and will therefore be able to arrive at a base primer composition, and to adjust the surfactant concentration of the primer composition in accordance with the process of the invention.

Suitable non-ionic or amphoteric surfactants include surfactants which are fluorinated alkyl polyoxyethylene ethanols; fluorinated alkyl alkoxylates; fluorinated alkylesters; alkyl polyethylene oxides; alkyl phenyl polyethylene oxides; acetylenic polyethylene oxides; polyethylene oxide block copolymers; amines, amides, esters (such as fatty acid esters) and diesters of polyethylene oxide; sorbitane fatty acid esters; glycerine fatty acid esters; fluorinated alky amphoteric mixture; polyethersiloxane copolymer; organo-modified polysiloxane; dimethyl-polysiloxane blends. Suitable ionic surfactants include anionic surfactants selected from ammonium perfluoroalkyl sulfonates; lithium perfluoroalkyl sulfonates; potassium perfluoroalkyl sulfonates; fatty acid salts; alkyl sulfate ester salts; alkylaryl sulfonate salts, dialkyl sulfosuccinate salts, alkyl phosphate ester salts and polyoxy ethylene-alkyl sulphate esters salts. Suitable cationic surfactants include fluorinated alkyl quaternary ammonium iodides.

Optionally, the primer comprises up to 5%, preferably up to 1% by weight of the surfactant.

The inclusion of a particulate filler such as silica in the primer has generally been found to give an increase in the linewidth and a decrease in contact angle as compared to the same primer without the particulate filler. The degree of the change will vary with the nature and concentration of the particulate filler, the substrate, the ink, and with the composition of the primer itself. However, as with surfactants, it will be within the ability of the skilled person to identify by trial and error for any substrate/ink/primer combination the changes to be expected on addition of a given particulate filler. Suitable particulate fillers include silica, calcium carbonate, titanium dioxide and clay. Silica is preferred due to its lack of colour. Suitable silicas include Ludox TMA, SyloJET DAZL 703A, Syloid W300, Syloid 72 and Syloid ED2 from Grace Davison.

Optionally, the primer comprises from 1 to 30%, preferably from 1 to 8% by weight of the particulate filler.

As mentioned above, inclusion of a fluorinated surfactant in the primer has generally been found to reduce linewidth whereas inclusion of a particulate filler tends to increase linewidth. Adjusting the concentration of a surfactant and/or the concentration of a particulate filler in the primer in accordance with the process of the invention allows for optimisation of the print quality obtained for a wide range of substrate/ink combinations. In particular, the printing operator can, by adjusting the surfactant and/or particulate filler concentration in the primer, obtain high quality printing on a wide range of substrates with a single ink family, thereby reducing the need to change inks.

As mentioned above, the primer may comprise a resin. The resin may, in the primer composition, act to seal the surface of a porous substrate and/or to bind together other components of the primer, such as the particulate filler, and/or to promote adhesion of the primer to the substrate.

Commercially available resins are often sold in the form of a solution of a resin in a solvent or in the form of an emulsion of the resin in water and those solutions and emulsions are sometimes referred to as resins. As used herein, however, unless the context makes it clear that the contrary is intended, the word "resin" refers only to those components which remain in the dry primer layer and therefore excludes solvents and other volatile components which are lost when the primer dries.

The resin is preferably not coloured and is advantageously such that it dries to a transparent, colourless dry layer on the substrate. Additionally, the resin should be compatible with the substrate, that is, it should not give rise to any unwanted reactions with the substrate over the lifetime of the printed product.

The resin may be polymeric or oligomeric. The resin may be curable such that it cures to a polymeric material either on drying or on exposure to radiation.

In a preferred embodiment, the resin is in the form of an emulsion. The resin may be, for instance, an acrylic emulsion, a styrene acrylic emulsion, a polyurethane emulsion, a urethane/acrylic emulsion or a vinyl emulsion. Joncryl 142 and Joncryl 8003 from Johnson Polymer B.V. and Diamond Coat Prime 4507 and Diamond Coat Work and Turn 5400 from Rycoline Products Inc. are suitable acrylic resins. Lucidene 141 and Lucidene 143 from Morton International Limited are suitable styrene acrylic emulsions. Lucidene 645 from Morton International Limited is a suitable polyurethane emulsion. Neorad QC526A from Neoresins is a suitable urethane/acrylic emulsion. Airflex EAF 375 and Airflex EV25 from Air Products are suitable vinyl resins.

Diamond Coat Prime 4507 and Diamond Coat Work and Turn 5400 are preferred resins.

The primer advantageously comprises from 1 to 50%, and preferably from 5 to 48% of a resin (based on the dry weight of the resin).

The adjustment of the composition of the primer may involve changing the concentration of a resin in the primer. For example, it may be desirable to increase the concentration of resin in the primer to improve the colour strength on a porous substrate.

The apparatus of the invention will, in general, be a print line or print assembly for commercial printing of goods such as packaging, display signs and labels. The apparatus comprises a reservoir for primer, such as a stirred tank. The apparatus also comprises means for adjusting the composition of the primer which may be any means for adding components to the primer, for example pumps and piping for adding surfactants, particulate fillers, resins and the like. In some cases, the reservoir may simply be provided with a port through which such components can be added manually.

Preferably, the apparatus comprises evaluation means for evaluating a characteristic relating to print quality. For example, the apparatus may include, downstream of the printer, a device for measuring linewidth, edge straightness, mottle, print density, gloss and/or colour intensity.

Preferably, the apparatus includes control means such as a microprocessor which communicates with the evaluation means, and is preferably arranged to record and display the results of the evaluation, and the relation to any target value. Advantageously, the control means communicates with the means for adjusting the composition of the primer and is arranged to control the adjustment in response to the evaluation of the characteristic relating to print quality.

In a preferred embodiment, the apparatus is a print line comprising a conveyor means such as a conveyor belt which conveys substrate, either as continuous feed or as a succession of discrete articles, through a means for applying primer which applies primer from a reservoir to the substrate, then past an ink jet print head, and then through an evaluation means for evaluating a characteristic relating to print quality. The apparatus may also comprise, upstream of the print head, means for drying or curing the primer. The apparatus may also comprise, downstream of the print head, means for drying or curing the ink.

In an especially preferred embodiment, the apparatus is a print line comprising:

a substrate storage and handling means such as a destacker or an unwind, means for carrying the substrate from the storage and handling means through the print line, such as a conveyor or web feed rollers, a cleaning station, for example, an electrostatic cleaner, a priming station for priming the substrate, optionally, a drying or curing station, a print engine, a drying station such as an oven or a curing station such as an array of UV lamps; and product storage and handling means for the printed product such as a stacker or rewind.

The apparatus preferably is capable of operating at such a speed that substrate travels from the substrate storage and handling means to the product storage and handling means in less than 5 minutes, preferably in 1 minute or less and especially preferably in 30 seconds or less.

In a separate aspect, the invention provides the use of a surfactant in a primer for use in an ink jet printing process for the modification of the wetting behaviour of an ink jet ink on a substrate primed with the primer.

In a further aspect, the invention provides the use of a particulate filler in a primer for use in an ink jet printing process for the modification of the wetting behaviour of an ink jet ink on a substrate primed with the primer.

In a yet further aspect, the invention provides the use of both a surfactant a particulate filler in a primer for use in an ink jet printing process for the modification of the wetting behaviour of an ink jet ink on a substrate primed with the primer.

The surfactant and/or particular filler may, in particular, be used to modify one or more characteristics from the group consisting of linewidth, edge straightness, mottle, spot size, print density, gloss, colour intensity and white lines.

All % herein are by weight, unless another meaning is clear from the context.

The invention is described below with reference to examples, for the purpose of illustration only.

EXPERIMENTAL

Inks

UV-curable jet ink A comprised, inter alia, 84.62% by weight of acrylate monomers, 0.2% by weight of polyether modified polysiloxane surfactant, 2.25% by weight pigment blue 15:4 and 1.8% Irgacure 369 as photoinitiator.

UV-curable jet ink B comprised 90.84% acrylate monomer, 1.91% of dispersant, 2.25% of pigment blue 15:4 and 5% Lucerin TPO as photoinitiator.

Substrates

The following substrates were used:

SCA Easyadd white corrugated board;

polyester sheet;

copy paper;

aluminium foil;

brown corrugated board; and

Kappa Brown, Kappa White and Kappa Grey papers.

Contact Angles

Contact angles were measured at various times after impact of the ink droplet on the primed or unprimed substrates as shown in the tables. A Fibrodat instrument was used. The droplet volume was 3.9 microlitres, using tubing of 0.2 mm internal diameter and a stroke pulse of 9.6.

Printing

A Spectra Nova 256 print head was used at a temperature of 45° C. The drop mass was 70 ng. Prints were made onto primed or unprimed substrate and were then UV cured at a dose of 400 mJ/cm$^2$.

Image Quality-linewidth

Image quality was assessed using a QEA apparatus according to the ISO 13660 procedure to give the linewidth of a printed line. All linewidth were measured at 2 seconds print to cure time.

Example 1

Overview of Primer Results on Porous and Non-porous Substrates

Primer A—a wax-containing UV curable primer was prepared having the composition shown in table 1. This was applied to the substrates at 70° C. as an 8 μm film and then allowed to cool to room temperature in air.

TABLE 1

Composition of Primer A

| Trade Name | Name | Type | Supplier | Parts by weight |
|---|---|---|---|---|
| Sartomer 9003 | propoxylated neopentyl glycol diacrylate | monomer | Sartomer | 55.9 |
| Lucerin TPO | | photo-initiator | BASF | 4.9 |
| Sartomer 399 | 2-phenoxyethylacrylate | monomer | Sartomer | 23 |
| Trigonal 12 | 4-phenylbenzophenone | photo-initiator | Akzo Chemie | 2 |
| Speedcure ITX | 2-isopropylthioxanthone | photo-initiator | Lambson Chemicals | 1.5 |
| Irgacure 369 | ketone photoinitiator | photo-initiator | Ciba | 0.5 |
| Speedcure EDB | ethyl 4-imethylamino benzoate | photo-initiator | Lambson Chemicals | 2 |
| Megaface F479 | | surfactant | DIC | 0.2 |
| Syncrowax ERL | hydrocarbon | wax | Croda | 10 |

Primer B was a water-based UV curable primer comprising 95.24% by weight of Neorad QC526A, a urethane acrylate oligomer emulsion available from Neoresins and 4.76% by weight Irgacure 500, a photoinitiator. The total water content of the primer was 57% by weight.

Primer C was a water-based UV-curable primer comprising silica. The composition was 55 parts Neorad QC526A, 5 parts Irgacure 500 and 40 parts silica.

Primer D was a water-based UV-curable primer comprising an anionic fluorinated surfactant, Zonyl FSP. The composition was 94 parts Neorad QC526A, 5 parts Irgacure and 1 part Zonyl FSP (DuPont).

Primer E was a water-based UV-curable primer comprising both silica and the fluorinated anionic surfactant. The composition was 54 parts Neorad QC526A, 5 parts Irgacure 500, 40 parts silica and 1 part Zonyl FSP.

Primer F was a 1% solution of the fluorinated anionic surfactant, Zonyl FSP in ethanol.

Primers B-F were applied to the substrates as a 4 μm film by coating with a wire-wound bar and allowed to air dry.

Table 2 shows an overview of print quality results obtained for a variety of primer compositions on porous substrates and non-porous substrates.

TABLE 2

Overview of results showing primers which promote ink spreading and good definition on porous and non-porous substrates

| | Porous Media | | Non-porous Media | |
|---|---|---|---|---|
| Primer | Good for ink spread | Good for definition | Good for ink spread | Good for definition |
| A | ✓ | ✓ | x | ✓ |
| B | x | x | ✓✓ | x |
| C | ✓✓ | x | ✓ | x |
| D | x | ✓✓ | x | ✓✓ |
| E | x | ✓✓ | x | ✓✓ |
| F | x | x | ✓ | ✓✓ |

Ink spreading is desirable in printed images having solid areas of print in order to avoid streaking defects. High definition is, in contrast, desirable for clarity in images which contain features such as text. Optimum printing of any particular image involves achieving a balance of those two factors.

As shown in table 1, the surfactant-only primer F gave poor results on porous substrates, due to a lack of sealing of the pores. On non-porous substrates, by contrast, where no sealing is required, primer F gave good results.

The water-based UV-curable primer B gave good ink spreading on both porous and non-porous substrates. Inclusion of silica (primer C) further increased the ink spreading. Inclusion of surfactant (primer D) produced the opposite effect and improved definition at the expense of spreading. Inclusion of both silica and surfactant (primer E) gave results similar to primer E, showing that the effect of the surfactant can be greater than the effect of the silica.

Example 2

Effect of Different Primer Compositions on Three Different Papers

Primers A to E as described in example 1 were applied to three different papers (Kappa White, Kappa Brown and Kappa Grey). Jet ink A was printed on to the primed samples and onto an umprimed control sample and cured. The linewidths (μm) were measured and are given in table 3.

TABLE 3

Linewidth (μm) of Ink A on various primed and unprimed papers

| | Primer | | | | | |
|---|---|---|---|---|---|---|
| | Control | A | B | C | D | E |
| Linewidth on Kappa White | 272.97 | 170.11 | 195.51 | 351.13 | 69.75 | 90.36 |
| Linewidth on Kappa Brown | 247.94 | 137.99 | 181.81 | 325.68 | 78.5 | 88.88 |
| Linewidth on Kappa Grey | 291.03 | 179.49 | 181.92 | 330.63 | 79.15 | 71.8 |

The control, having no primer, gave very poor colour strength due to the ink being drawn into the pores of the paper. The primers, which either contained a resin (B-E) or a wax (A) gave good sealing of the surface and much improved colour strength. Moreover, the variation in linewidth over the three papers for each of the primers is lower than the variation for the control samples, showing that the primers reduced variability due to substrate.

The results of table 2 show that the wetting behaviour of an ink on a surface primed with a base primer formulation such as primer B may be controlled by addition of a particulate filler such as silica, which gave an increase in linewidth, and by the addition of surfactant, which gave a decrease in linewidth.

Example 3

Surfactant Primers on Polyester

Five primers were prepared by making up five 1% solutions in ethanol of five different surfactants of differing types. The surfactants used were Zonyl FSP (an anionic fluorinated surfactant from DuPont), Lodyne 106A (a cationic fluorinated surfactant from Ciba Specialities), Zonyl FSK (an amphoteric fluorinated surfactant from Du Pont), Megaface F479 (a nonionic fluorinated surfactant from DIC) and Tegoglide A115 (a silicone surfactant from Tego-Chemie). The primers were each applied to a separate sample of polyester film and then dried. The primed films, together with a control sample of unprimed film, were then printed with jet ink B. Linewidth results are shown in table 4.

TABLE 4

Linewidth results for surfactant primers on polyester

| Surfactant Used | Linewidth (μm) |
|---|---|
| None | 92.4 |
| Anionic fluorinated | 77.56 |
| Cationic fluorinated | 82.4 |
| Amphoteric fluorinated | 68.95 |
| Nonionic fluorinated | 149.26 |
| Silicone | 145.99 |

The results show that it is possible to either increase or decrease linewidth, as compared to a non-primed substrate, by including an appropriate surfactant in the primer.

Example 4

Effect of Surfactant Concentration

1%, 0.1% and 0.01% solutions of Zonyl FSP, an anionic fluorinated surfactant, in ethanol were applied to polyester film and dried. A UV jet ink corresponding to ink B but having 89.84% acrylate monomers and 1% of a silicone surfactant was applied to the primed samples as well as to an unprimed control sample. The contact angles of the ink droplets on the surface were measured at certain time periods after impact of the droplets on the surface. Results are shown in Table 5.

TABLE 5

Contact angle results for unprimed polyester and polyester primed with primers having 0.01%, 0.1% and 1% surfactant

| | | Anionic fluoro surfactant | | |
|---|---|---|---|---|
| Time | Uncoated | 1% | 0.10% | 0.01% |
| 0.2 s | 32.8° | 57.1° | 37.2° | 31.3° |
| 1 s | 19.5° | 55.3° | 31.1° | <19.1° |

TABLE 5-continued

Contact angle results for unprimed polyester and polyester primed with primers having 0.01%, 0.1% and 1% surfactant

| | | Anionic fluoro surfactant | | |
|---|---|---|---|---|
| Time | Uncoated | 1% | 0.10% | 0.01% |
| 2 s | 15.7° | 54.9° | 30.1° | <<19.1° |
| 5 s | <15.7° | 54.7° | 29.9° | <<<19.1° |

Table 4 shows that the 0.01% solution did not differ appreciably from the unprimed sample. The 0.1% primer increased the contact angles as compared to the unprimed sample and the 1% primer gave a stronger effect. Thus, it is possible to adjust the wetting behaviour of the ink by adjusting the surfactant concentration in the primer.

Example 5

Water-based UV-curable Primer Comprising Surfactant on Porous Substrates

Samples of Kappa Brown, Grey and White papers were primed with primer D (see example 1). Jet ink A was then printed onto primed and unprimed papers. Linewidth measurements are shown in table 5.

TABLE 5

Linewidth results for papers primed with primer D

| | Kappa papers | | |
|---|---|---|---|
| Primer | Brown | Grey | White |
| None | 250.85 | 283.31 | 321.65 |
| Primer D | 78.5 | 79.15 | 69.75 |

The results show that primer D gives much better definition, as compared to the unprimed sample. Colour strength was also greatly improved in the primed samples.

The invention claimed is:

1. A process of ink jet printing in which:

i) a primer is applied to a substrate material;

ii) ink is ink jet printed onto the primed substrate;

iii) a characteristic relating to print quality is evaluated;

iv) the composition of the primer is adjusted based on the evaluated characteristic relating to print quality; and v) the adjusted primer composition is applied to the substrate material and ink is ink jet printed onto the primed substrate material to give a printed product.

2. A process as claimed in claim 1 wherein at least steps i), ii), iv) and v) are carried out on-line during a printing run.

3. A process as claimed in claim 2 wherein steps i), ii), iii), iv) and v) are all carried out on-line during a printing run.

4. A process as claimed in claim 1, wherein the ink is printed from a single pass ink jet printing device.

5. A process as claimed in claim 1, wherein step iv) involves adjusting the concentration of surfactant in the primer.

6. A process as claimed in claim 1, the primer is a solution of a surfactant in a volatile solvent.

7. A process as claimed in claim 1, wherein step iv) involves adjusting the concentration of a particulate filler in the primer.

8. A process as claimed in claim 7 wherein the particulate filler is silica.

9. A process as claimed in claim 1, wherein step iv) involves the step of adjusting the concentration of a resin in the primer.

10. A process as claimed in claim 1, wherein the characteristic relating to the print quality is selected from the group consisting of linewidth, edge straightness, mottle, spot size, print density, gloss, colour intensity and white lines.

11. A process as claimed in claim 1, wherein the characteristic relating to the print quality is selected from the group consisting of linewidth, edge straightness, spot size, mottle, print density, gloss and colour intensity.

12. A process as claimed in claim 1, wherein steps iii) and, if necessary, step iv) are repeated at intervals during a print run.

13. A process as claimed in claim 1 wherein the ink is printed onto wet primer.

14. A process as claimed in claim 1 wherein which the primer is dried or cured before being printed on.

15. A process as claimed in claim 1, wherein the ink is radiation-curable.

16. An ink jet printing apparatus comprising i) a reservoir of primer;

ii) means for adjusting the composition of the primer;

iii) means for applying the primer to a substrate; and iv) means for ink jet printing onto the substrate.

17. An ink jet printing apparatus as claimed in claim 16 which comprises evaluation means for evaluating the characteristic relating to print quality.

18. An ink jet printing apparatus as claimed in claim 17 which comprises control means which communicates with the evaluation means and with the means for adjusting the composition of the primer.

* * * * *